United States Patent [19]

Steffens et al.

[11] 4,032,133

[45] June 28, 1977

[54] ROLLER POSITIONING METHOD AND APPARATUS FOR BUCKLE-TYPE PAPER FOLDING MACHINE

[76] Inventors: Charles J. Steffens; Scott D. Steffens, both of 1855 Techny Road, Northbrook, Ill. 60062

[22] Filed: Sept. 11, 1975

[21] Appl. No.: 612,489

[52] U.S. Cl. ..... 270/68 A
[51] Int. Cl.[2] ..... B65H 45/14
[58] Field of Search ..... 270/68 A, 68 R

[56] References Cited

UNITED STATES PATENTS

| | | | |
|---|---|---|---|
| 2,699,331 | 1/1955 | McGarvey | 270/68 A |
| 3,150,871 | 9/1964 | Boblit | 270/68 A |
| 3,510,122 | 5/1970 | Gavaghan | 270/68 A |

*Primary Examiner*—Edgar S. Burr
*Assistant Examiner*—A. Heinz
*Attorney, Agent, or Firm*—Leydig, Voit, Osann, Mayer & Holt, Ltd.

[57] ABSTRACT

Roller positioning method and apparatus for buckle-type folding machines characterized by a roller movement parallel to the subjacent fold plate to facilitate adjustment and to prevent unintended interference between the roller surfaces and the fold plates.

2 Claims, 2 Drawing Figures

Figure 1:
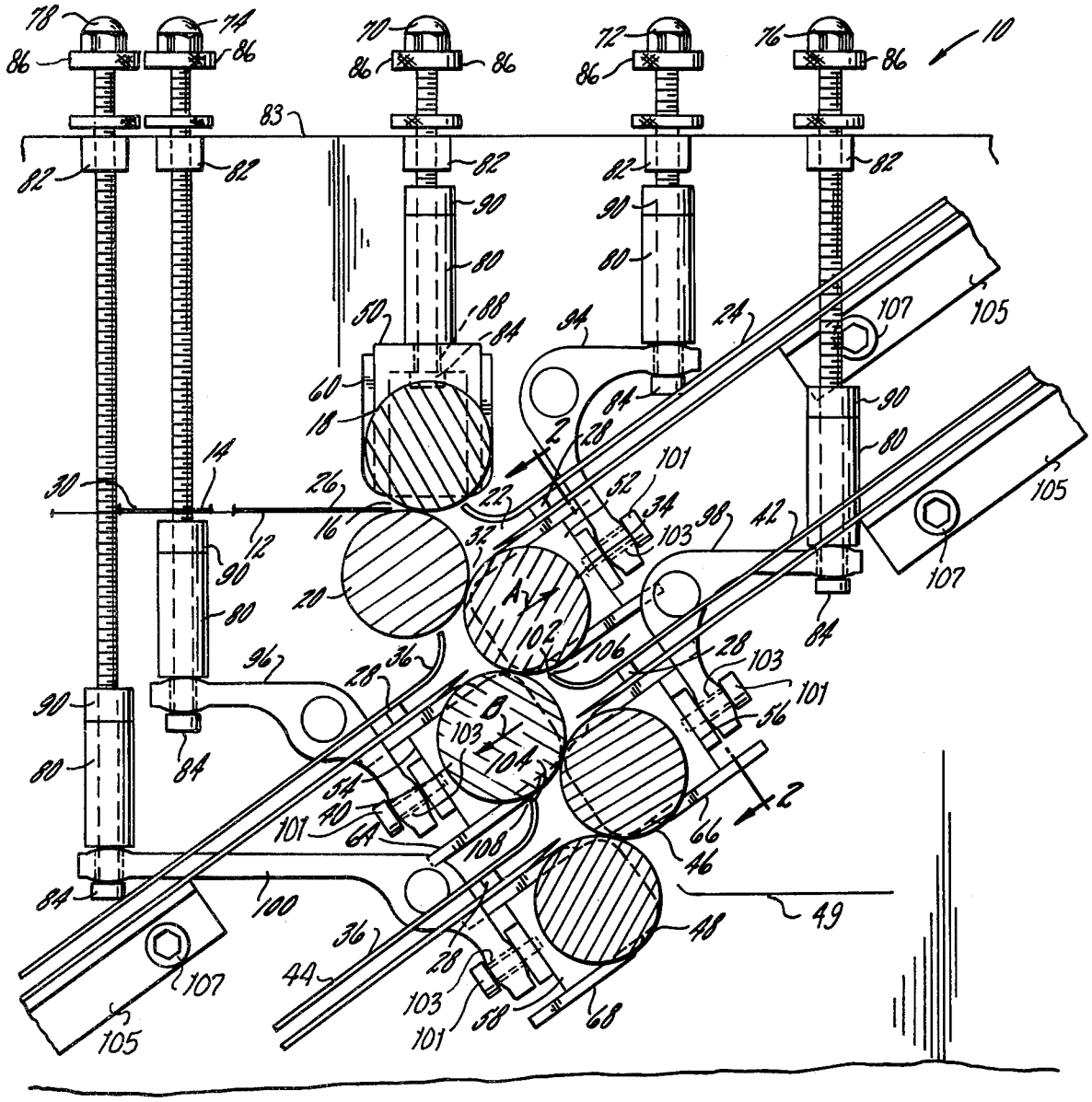

70
72
76
86
86
86
83
82
82
82
90
90
80
80
60
94
50
84
62
52
18
106
24
20
102
28
34
36
28
40

ROLLER POSITIONING METHOD AND APPARATUS FOR BUCKLE-TYPE PAPER FOLDING MACHINE

BACKGROUND OF THE INVENTION

This invention relates generally to buckle-type folding machines and, more particularly, to the method and apparatus provided for positioning the rollers with respect to one another.

In buckle-type folding machines, several rollers cooperate with the series of fold plates to generate one or more folds in a previously unfolded sheet of paper. The rollers, typically from three to six in number, are arranged with their axes mutually parallel and in a zig-zag relationship, the angle formed by connecting three successive axis being approximately 90°. The spacing between the adjacent rollers is such that when the rollers are driven with equal peripheral velocities, the combined driving action of two adjacent rollers will capture a leading edge of a piece of paper presented at the roller interface and convey it through the gap between the rollers.

The zig-zag arrangement results in a pocket being formed by each three successive rollers. Projecting into any or all of these pockets are fold plates. Each fold plate (a maximum in number of N-2 where N is the number of rollers) has a cavity, the opening of which is arranged to receive the leading edge of a piece of paper as it is conveyed toward the fold plate by the driving action of the first and second roller of a three-roller group. An adjustable stop permits the leading edge of the paper to penetrate the cavity to only a predetermined extent, whereupon the continued conveyance of trailing portion of the piece of paper causes the paper to buckle toward the interface between the second and third rollers of the three-roller group. The driving action of the second and third rollers results in the capture of the buckled portion of the paper, thereby generating a fold. Upon emerging on the other side of the second and third roller interface, the folded paper is conveyed into either another fold plate for an additional folding operation or a receiving tray for collection.

To perform the above-described conveying and folding operations, the spacing between the various rollers and between the rollers and the fold plates must be maintained to within close tolerances. The roller-to-roller spacing is critical in order to assure positive conveying action without subjecting the paper and rollers to excessive contact pressure therebetween. The roller-to-fold plate spacing is critical to assure that as the paper is conveyed toward a fold plate, it will be directed into the fold plate cavity and not between the fold plate and the roller periphery where it might jam. In addition, when non-resilient (e.g., metal) rollers are utilized, the rollers must be resiliently mounted to prevent jamming in the event multiple thicknesses of paper are introduced between two rollers.

Known roller positioning methods and apparatus are subject to several disadvantages. Typically, the ends of one or more of the rollers are journalled in either rocker arms or translating bearing blocks. Whichever is employed, the direction of travel of a given roller is generally along a radial line away from the next preceding roller. As a result, the direction of travel of the roller is at an angle, on the order of 45°, with the subjacent fold plate. Hence, any adjustment of the roller position necessarily affects the spacing between the roller periphery leading edge of the and the fold plate. The result is that the fold plate position must then be adjusted to restore the proper spacing between the roller surface and the fold plate leading edge. A further serious disadvantage of having the direction of travel form an oblique angle with the subjacent fold plate is that whenever multiple thicknesses of paper are inadvertently run between a set of rollers, the second roller, being resiliently mounted, may be displaced into an interfering relationship with the leading edge of the subjacent fold plate. Should this occur, serious damage to both the roller surface and the fold plate may result.

Accordingly, it is an object of the present invention to provide an adjustable roller positioning method and apparatus which has a resilient mounting feature but which nevertheless precludes the possibility of interference between the rollers and the leading edges of the fold plates in the event multiple thicknesses of paper are inadvertently conveyed between two rollers.

A related object of the present invention is to provide a roller positioning method and apparatus which permits ready adjustment of the spacing between the rollers without also requiring readjustment of the spacing between the rollers and the leading edges of the subjacent fold plates.

Still another object of the present invention is to provide a roller positioning system having standardized components to facilitate replacement of parts and repair of the apparatus.

Figure 2:
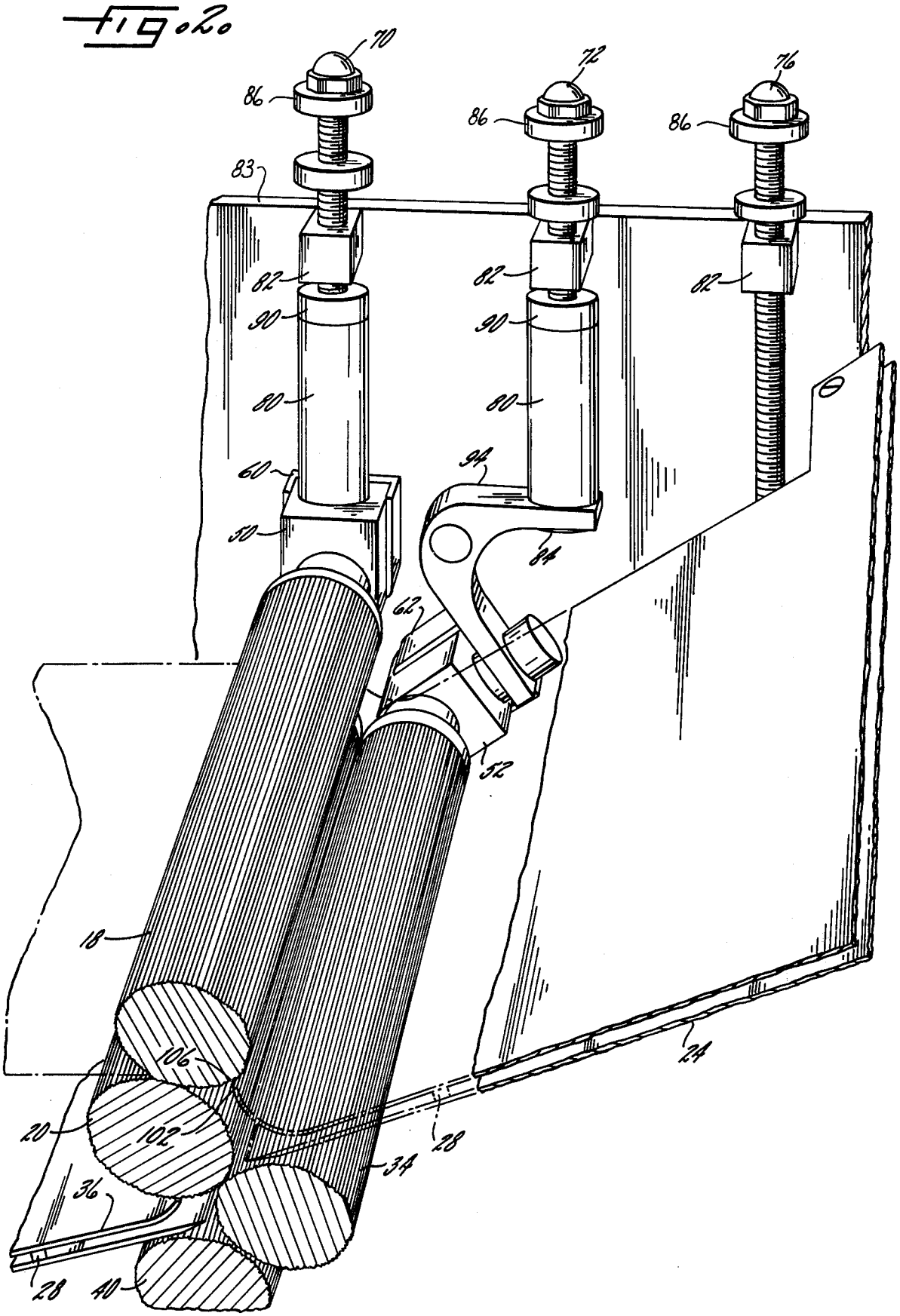

Other objects and advantages of the invention will be apparent from the following detailed description taken in connection with the accompanying drawings, in which:

FIG. 1 is a side elevation of a six-roller, four-fold plate buckle-type folding machine which embodies the features of the invention; and FIG. 2 is a perspective view of the roller positioning apparatus according to the present invention as incorporated into a buckle-type folding machine.

While the invention is susceptible of various modifications and alternative forms, specific embodiments thereof have been shown by way of example in the drawings and will herein be described in detail. It should be understood, however, that it is not intended to limit the invention to the particular forms disclosed, but, on the contrary, the intention is to cover all modifications, equivalents and alternatives falling within the spirit and scope of the invention as expressed in the appended claims.

Shown in the drawings is a six-roller, four-fold plate, buckle-type folding apparatus 10, four resiliently biased fold rollers of which are equipped with positioning means according to the invention. Turning specifically to FIG. 1 for a brief description of the operation of the apparatus, all rollers are driven at equal peripheral speeds by suitable drive means (not shown). Such roller drive means are well known in the art and do not constitute a feature of the present invention. Conventional feed means 12 present a paper blank 14 to the interface 16 between rollers 18 and 20. The rotating rollers 18 and 20 engage the blank 14 and convey it therebetween and into the cavity 22 of the fold plate 24. When the leading edge 26 of the blank 14 reaches fold plate stop 28, the continued engagement of the rollers 18 and 20 with the trailing portion 30 of the blank 14 causes it to buckle toward the interface 32 of rollers 20 and 34. Rollers 20 and 34 then engage the buckled portion of the blank 14 and convey it therebetween, generating a fold. In a similar manner, the folded blank 14 is conveyed into the fold plate 36, caused to buckle, and folded again as it is engaged by and passes between rollers 34 and 40. The conveying and folding processes continue with fold plates 42 and 44 cooperating with rollers 40, 46 and 48 to generate a total of four folds in the blank. Fewer than four folds can be achieved by bypassing one or more of the folding operations in a manner well known in the art. Upon emerging from between rollers 46 and 48, the folded paper is deposited in receiving tray 49.

Still referring to FIG. 1, the axis of roller 20 is fixed with respect to the frame 83. A second roller 18 is mounted for vertical translational movement to facilitate adjustment of the spacing between the rollers 18 and 20 depending upon the thickness of the paper to be folded.

In accordance with an important aspect of the present invention, all four of the remaining rollers 34, 40, 46 and 48 are mounted for translational movement parallel to the mutually parallel fold plates 24, 36, 42 and 44. The fold plates 24, 36, 42 and 44 are removably attached by conventional means (not shown) to brackets 105 bolted to the frame by cap screws 107. The holes (not shown) in the brackets 105 through which the cap screws 107 pass may be slightly oversized to permit adjustment of the fold plate position. The ends of all five of the translating rollers 18, 34, 40, 46 and 48 are journaled in bearing blocks 50, 52, 54, 56 and 58 which in turn translate in channels 60, 62, 64, 66 and 68. The channels 60, 62, 64, 66 and 68 may be attached to the frame 83 by any suitable means, as, for example, by welding. The positions of the bearing blocks 50, 52, 54, 56 and 58 in the respective channels 60, 62, 64, 66 and 68, are controlled through the combined effects of adjusting screws 70, 72, 74, 76 and 78 and resilient sleeves 80.

Referring again to FIG. 1, the adjusting screw 70 passes directly through the bearing block 50 and threads through an extension 82 of the frame 83 terminating in a knurled knob 86 to facilitate hand adjustment. The head 84 of the adjusting screw 60 defines the lower limit of travel of the bearing block 50 toward the stationary roller 20. The hole 88 in the bearing block 50 being a clearance hole, the bearing block is permitted to travel upward against the downward bias exerted by resilient sleeve 80 upon the bearing block 50. The magnitude of the bias may be readily adjusted by the selective positioning of collar 90 to bear upon the upper end of the resilient sleeve 80 with a force equal to the desired separation force of the rollers 18 and 20. The resilient sleeves 80 may be either coil springs or, in a preferred embodiment, tubular neoprene rubber.

The arrangement with respect to the other four translating rollers 34, 40 46 and 48 is similar to that associated with the vertically translating roller 18 except for the interpositioning of rocker arms 94, 96 98 and 100 between the adjusting screws 72, 74, 76 and 78 and the bearing blocks 52, 54, 56 and 58. The rocker arms are flexibly connected to the bearing blocks by pins 101. It will be appreciated that the holes 103 in the rocker arms 94, 96, 98 and 100 through which the pins 101 pass must be slightly elongated in the plane of FIG. 1 in order to permit the bearing blocks 52, 54, 56 and 58 to translate while the rocker arms pivot about their mounting axes. By using the rotational movement of the rocker arms to generate translational movement of the bearing blocks in the channels, the adjusting screws can be arranged for easy accessibility. In the apparatus shown in FIG. 1, an included angle of approximately 45° between the legs of rocker arms 94 and 98 and an included angle of approximately 135° between the legs of rocker arms 96 and 100 permit all adjusting screws to be arranged vertically.

FIG. 2 is a perspective view of roller 34 and its associated roller positioning apparatus. The head 84 on the adjusting screw 72 limits the travel of clockwise rotation of the rocker arm 94, while resilient sleeve 80 acts to restrict the counterclockwise rotation of the rocker arm 94 with a force equal to the preload set up in the sleeve by the locking collar 90.

It will be appreciated that the above-described arrangement avoids the several disadvantages of the heretofore known buckle-type paper folding machines. Since the rollers 34 and 40 are arranged to slide parallel to the fold plates 42 and 44, respectively, they can be freely adjusted without effect upon the spacing between the roller peripheries and the fold plate leading edges 102 and 104. Hence, the gaps 106 and 108 are virtually unchanged over a wide range of adjustment of the rollers 34 and 40. As a result, once the plates are located to achieve the desired spacing between themselves and the superjacent rollers, frequent subsequent adjustment should not be necessary.

Furthermore, should an unexpected thickness of paper be presented between stationary roller 20 and translatable roller 34, the translatable roller will be displaced in the direction of arrow A to permit the excessive thickness to pass between the rollers. This arrangement serves the important function of preventing interference between the roller 34 and the leading edge 102 of the fold plate 42. Similarly, a paper jam between rollers 34 and 40 will result in roller 40 being displaced in the direction of arrow B without interference with the leading edge 104 fold plate 44.

As a final point, the bearing blocks 52, 54, 56 and 58 can be made to the same specifications. This arrangement reduces the number of parts which must be stocked to assure that ready replacement parts are available.

We claim as our invention:

1. A buckle-type folding machine for successively folding sheets of paper comprising a frame, first and second elongated rollers disposed in parallel relation defining a nip through which paper sheets can be successsively passed and folded, means for supporting said first roller for rotational movement about its axis, means for rotably driving said rollers, an elongated fold plate having a paper receiving cavity into which said sheets are directed for buckling said sheets prior to folding, said fold plate having a leading edge in close proximity to said second roller said fold plate being disposed at an acute angle to a line passing through the centers of said rollers, means for supporting said second roller for rotational movement about its axis as well as limited lateral movement relative to said frame in a direction perpendicular to its axis and parallel to said fold plate, said second roller supporting means including a pair of bearing blocks between which the ends of said second roller are rotably journaled, a pair of channels fixed to said frame, said bearing blocks each being slidably disposed within a respective one of said channels, said channels being mounted in a plane parallel to said fold plate so that upon passage of a folded sheet through said nip said second roller separates from said first roller through non-radial movement in a direction parallel to the plan of said elongated fold plate to allow passage of said sheets while not substantially changing the spacing between said second roller and said fold plate leading edge, a pair of rockers pivotedly mounted on said frame and having first and second legs, means coupling the first leg of each rocker to one of said bearing blocks so that lateral movement of said bearing blocks within said channel upon passage of said folded sheets through said nip causes rotational movement of said rockers, and bias means acting on the second leg of each said rocker for urging said rockers, bearing blocks, and second roller to their original positions following passage of a folded sheet through said nip.

2. The folding machine of claim 1 in which said first rocker arm coupling means is a flexible connector which permits translational movement of said bearing block in said channel in response to pivotable movement of said rockers.

* * * * *